US008672715B2

(12) United States Patent
Yuan

(10) Patent No.: US 8,672,715 B2
(45) Date of Patent: Mar. 18, 2014

(54) ELECTRICAL CONTACT WITH TWO CONTATING PORTIONS AND ELECTRICAL CONNECTOR WITH THE SAME

(75) Inventor: Wei Yuan, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 3 days.

(21) Appl. No.: 13/589,191

(22) Filed: Aug. 20, 2012

(65) Prior Publication Data

US 2013/0052856 A1 Feb. 28, 2013

(30) Foreign Application Priority Data

Aug. 31, 2011 (CN) ..... 2011 1 0254485

(51) Int. Cl.
*H01R 13/627* (2006.01)

(52) U.S. Cl.
USPC ..... 439/650

(58) Field of Classification Search
USPC ..... 439/350, 78, 620.04, 620.07, 620.18, 439/357, 353
See application file for complete search history.

(56) References Cited

U.S. PATENT DOCUMENTS

| | | | | |
|---|---|---|---|---|
| 7,377,797 | B2 * | 5/2008 | Tsai | 439/159 |
| 7,387,540 | B1 * | 6/2008 | Van der Steen | 439/660 |
| 8,408,931 | B2 * | 4/2013 | Sato et al. | 439/357 |
| 8,439,705 | B2 * | 5/2013 | Zhang | 439/607.06 |
| 8,491,336 | B2 * | 7/2013 | Cocquyt et al. | 439/587 |
| 8,500,463 | B2 * | 8/2013 | Tsai et al. | 439/78 |

FOREIGN PATENT DOCUMENTS

| | | |
|---|---|---|
| CN | 202282472 | 6/2012 |

* cited by examiner

*Primary Examiner* — Jean F Duverne
(74) *Attorney, Agent, or Firm* — Wei Te Chung; Ming Chieh Chang

(57) ABSTRACT

An electrical connector including: an insulative housing and a plurality of contacts, the insulative housing defining a first mating face, a second mating face and a mounting face opposite to the mating faces, each contact includes a retaining portion for engaging on the insulative housing and a pair of contact portions exposed on the first mating face and the second mating face respectively, wherein the first mating face is higher than the second face in a direction perpendicular to the mating first and second faces.

7 Claims, 3 Drawing Sheets

ELECTRICAL CONTACT WITH TWO CONTATING PORTIONS AND ELECTRICAL CONNECTOR WITH THE SAME

BACKGROUND OF THE INVENTION

1. Field of the Invention

The present invention relates to an electrical connector, specially to a compression connector connecting with two boards.

2. Description of Related Art

Chinese Utility Pat. No. CN202282472 discloses a connector elastically mating with contrary connector. The electrical connector includes a base and a plurality of contacts retained therein. Each contact has a retaining portion and a pair or elastic contact portions. The base defines two opposite mating faces and the contact portions are exposed to the mating faces respectively. Nevertheless, the height of the electrical system will be raised by mating with contrary connector at opposite mating faces.

Hence, an electrical connector of miniaturization is desired.

BRIEF SUMMARY OF THE INVENTION

Accordingly, an object of the present invention is to provide a miniaturized electrical contact and connector with the contacts.

To achieve the above object, an electrical connector including: an insulative housing and a plurality of contacts, the insulative housing defining a first mating face, a second mating face and a mounting face opposite to the mating faces, each contact includes a retaining portion for engaging on the insulative housing and a pair of contact portions exposed on the first mating face and the second mating face respectively, wherein the first mating face is higher than the second face in a direction perpendicular to the mating first and second faces.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
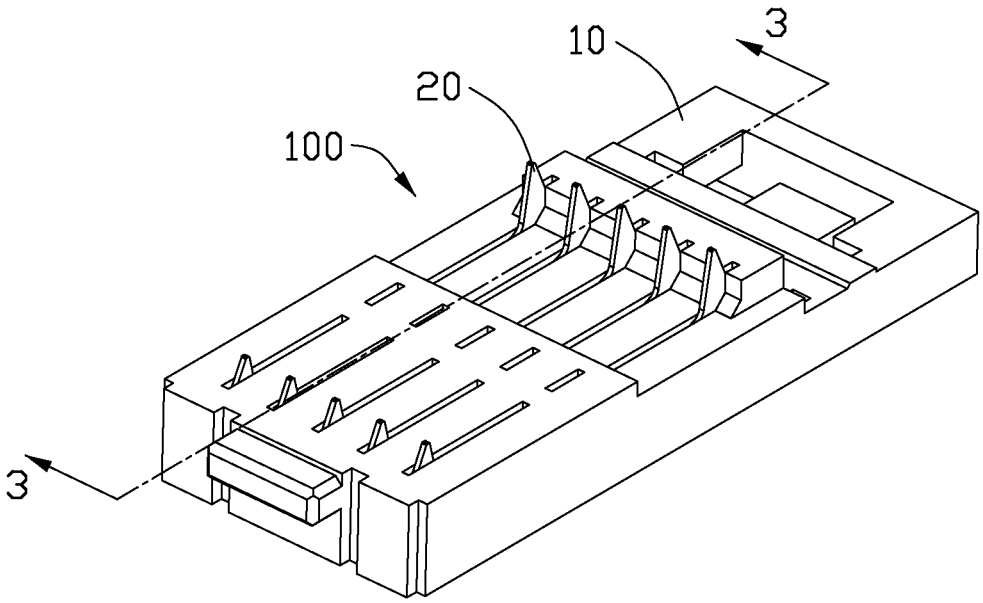
FIG. 1 is a perspective view of the electrical connector in accordance with a preferred embodiment of the present invention.

Reference will now be made to the drawing figures to describe the preferred embodiment of the present invention in details. FIG. 1 illustrates an electrical connector 100 intended to mate with two printed circuit boards (not shown). The electrical connector 100 comprises an insulative housing 10 and several contacts 20 retained therein.

Figure 2:
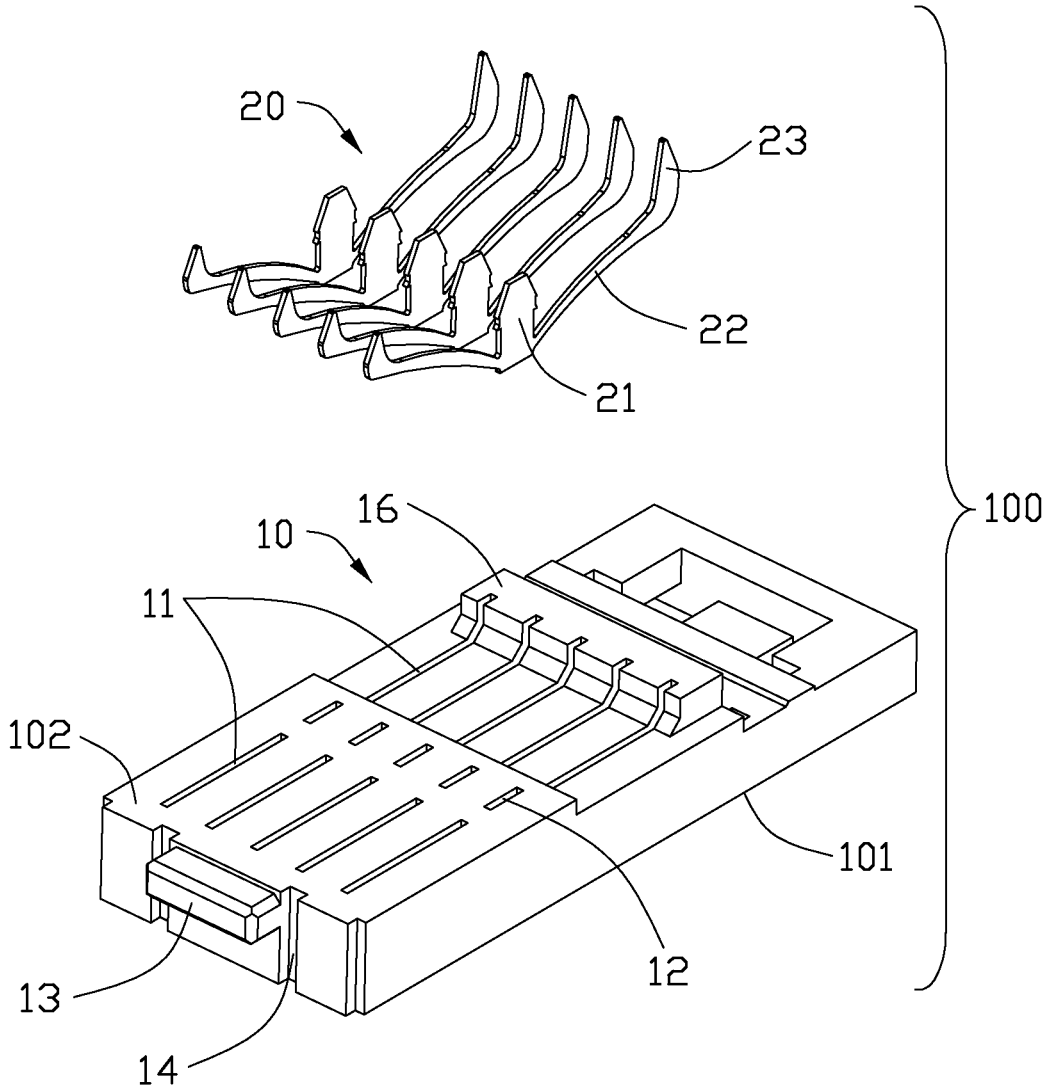
FIG. 2 is an exploded perspective view of the electrical connector as shown in FIG. 1.
Figure 3:
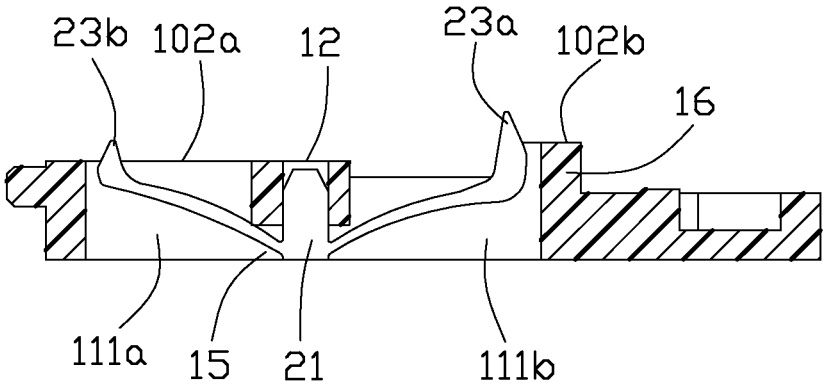
FIG. 3 is a cross sectional view of the electrical connector taken along lines 3-3 in FIG. 1.

Referring to FIG. 2 to FIG. 3, the insulative housing 10 is shaped as a rectangle, defining the bottom face as a mounting face 101 and an opposite end (upper end) as a mating end 102. The mating end 102 includes a first mating face 102*a* and a second mating face 102*b*. The second mating face 102*b* is parallel to the first mating face 102*a* and higher than the first mating face 102*a*. The contact-receiving passageways 11 includes two portions, first passageways 111*a* through the first mating face 102*a* and second passageway 111*b* through the second mating face 102*b*. The contact-receiving passageways 11 extend in a longitudinal direction of the housing. Several retaining passageways 12 are located between the two rows of contact-receiving passageways 11.

Referring to FIG. 2, each contact 20 made from a metal sheet comprises a retaining portion 21 with bars and a pair of elastic portions 22 in the same plane. The pair of elastic portions 22 extends from opposite sides of bottom end of the retaining portion 21. The two elastic portions 22 further vertically extend a contacting portion 23 parallel to the retaining portion 21, which are defined as a first contact portion 23*a* and second contact portion 23*b*. The extending direction of the first and second contact portions is perpendicular to the first and second mating face 102*a*, 102*b*. The second contact portion 23*b* is higher than the first contact portion 23*a* in the vertical direction. In fact, the height of the contact portions could be determined by actual demand. The contacting portions are located above the retaining portions in the vertical direction.

The pair of contact portions 22 is received in the contact-receiving passageway 11 and the retaining portion 21 is fixed in the retaining passageway 12 from the mounting face 101. The first and second contact portions 23*a*, 23*b* are exposed to and extend beyond the first and second mating face 102*a*, 102*b* respectively via the first passageways 111*a* and the second passageways 111*b*. The retaining passageways 12 run through the first mating face 102*a*. The top end of the retaining portion 21 is received in the retaining passageway 12, but not extends beyond the first mating face 102*a*. The bottom roots of the retaining portions 21 are received in a bottom space 15 defined in the bottom of the housing and do not extend beyond the mounting face 101. The contact portions are spaced from the side face of contact-receiving passageways 11 so as to decrease the friction therebetween.

The insulative housing includes a mounting rib 13 and a pair of slots 14 for being mounted to a mother board of said two printed circuit boards. The mounting rib 13 outwardly projects from one end adjacent to the first mating face 102*a* of the housing and parallel to the mating face. The slots 14 are orthogonally located at the both sides of the mounting rib 13 and vertically run through the first mating face 102*a* and the mounting face 101*a* protruding portion 16 is located at the second mating face 102*b* distant from the mounting rib 13. The top face of the protruding portion 16 is defined as the second mating face 102*b*. The second passageways 111*b* of the contact-receiving passageways 11 extend to the protruding portion 16 and run through the second mating face 102*b*. The electrical connector 100 is able to mate with a daughter board of said two printed circuit boards at the first mating face 102*a* and the second mating face 102*b*. The daughter board presses against said two contacting portions 23 so that the two elastic portions 22 swing in the passageways 111*a*, 111*b* to provide enough enforce to the daughter board. The height of electrical system will be reduced owing to the mating faces being located at the same side (top side).

While preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

an insulative housing defining a first mating face, a second mating face on one side of the insulative housing and a mounting face opposite to said two mating faces; and a plurality of contacts retained in the insulating housing, each comprising a retaining portion retained in the insulative housing and a pair of contacting portions exposed to the first mating face and the second mating face respectively;

wherein the first mating face is higher than the second face in a direction perpendicular to said first and second mating faces; wherein the contacting portions and the retaining portion are connected by a pair of elastic portions; wherein the pair of elastic portions extends from opposite sides of a bottom end of the retaining portion; wherein the insulative housing defines several retaining passageways receiving the retaining portions and a pair of contact-receiving passageways running through the first and second mating faces located at both sides of the retaining passageways receiving the elastic portions; wherein the retaining passageways pass through the first mating face and the retaining portion is not exposed to said first and second mating faces.

2. An electrical connector for mating with opposite first and second printed circuit boards, comprising:

an insulative housing defining opposite upward mating side and downward non-mating side in a vertical direction;

a plurality of contact-receiving passageways formed in the housing, extending through the housing in the vertical direction and defining opposite first part and second part in a lengthwise direction perpendicular to said vertical direction;

a plurality of contacts disposed in the corresponding contact-receiving passageways, respectively, and defining opposite first contacting portion and second contacting portion in said lengthwise direction, each of said first contacting portion and said second contacting portion exposed above the upper mating side for respectively mating with the corresponding first and second printed circuit boards which are adapted to be commonly located upon the upward mating side for electrical connection between the first printed circuit board and the second printed circuit board; wherein said contacts and the corresponding contact-receiving passageways are configured and dimension to allow the contacts to be only upward assembled into the corresponding contact-receiving passageways, respectively, from the non-mating side; wherein said mating side defines first and second mating faces thereon at different levels in the vertical direction; wherein the first contacting portion and the second contacting portion extend upwardly to be terminated at different levels in compliance with said first and second mating faces, respectively.

3. The electrical connector as claimed in claim 2, wherein the first mating face is higher than the second mating face, and further defines a recess region lower than the second mating face for heat dissipation.

4. The electrical connector as claimed in claim 2, wherein each of said contacts defines a retention portion between the corresponding first contacting portion and the second contacting portion in the lengthwise direction.

5. The electrical connector as claimed in claim 4, wherein each of said contact-receiving passageways is associated with a retaining passageway between the first part and the second part, into which the retention portion of the corresponding contact is received.

6. The electrical connector as claimed in claim 4, wherein in each of the contacts, the first contacting portion and the second contacting portion upwardly extend oppositely from a same level of said corresponding retention portion in the lengthwise direction.

7. The electrical connector as claimed in claim 2, wherein each of said contacts only mechanically and electrically connects to said first and second printed circuit board on the mating side without further mechanical and electrical connection with others on the non-mating side.

* * * * *